United States Patent [19]

Miller

[11] Patent Number: 4,915,748

[45] Date of Patent: Apr. 10, 1990

[54] ALUMINUM ALLOYS

[75] Inventor: William S. Miller, Gerrards Cross, United Kingdom

[73] Assignee: Alcan International, Buckinghamshire, United Kingdom

[21] Appl. No.: 198,595

[22] Filed: May 20, 1988

Related U.S. Application Data

[63] Continuation of Ser. No. 874,838, Jun. 13, 1986, abandoned, which is a continuation of Ser. No. 528,706, Sep. 1, 1983, abandoned.

[30] Foreign Application Priority Data

Sep. 3, 1982 [GB] United Kingdom ..... 8225297

[51] Int. Cl.[4] ..... C22F 1/04

[52] U.S. Cl. ..... 148/12.7 A; 148/415; 148/416; 148/417

[58] Field of Search ..... 420/528; 148/11.5 P.12.7 A, 415–417, 437–440

[56] References Cited

U.S. PATENT DOCUMENTS 4,347,076 8/1982 Ray et al. ..... 148/11.5 P

FOREIGN PATENT DOCUMENTS 424854 11/1945 Canada .
729122 2/1966 Canada .
0143727 6/1985 European Pat. Off. .
1817499 8/1969 Fed. Rep. of Germany .
461962 8/1975 U.S.S.R. .
1104573 2/1968 United Kingdom .
1338974 6/1973 United Kingdom .

OTHER PUBLICATIONS

"Production and Processing of Rapidly Solidified Aluminium Alloys", I. R. Hughes, G. J. Marshall and W. S. Miller, Elsevier Science Publ., 1985.

"Developments in Aluminium Alloys by Solidification at Higher Cooling Rates", H. Jones, Sheffield (UK), Communication from Dept. of Metallurgy, University of Sheffield.

The Physical Metallurgy and Mechanical Properties of Aluminum Alloys Containing 8–12 wt % Fe, D. Skinner, K. Okazaki and C. Adam, ASTM Symposium on Rapidly Solidified Powder Aluminum Alloys, Apr. 4–6, Phila., Pa.

PM Aerospace Materials, vol. 2, A Metal Powder Report Conference, Berne, Switzerland, Nov. 12–14, 1984.

Databook 1978 Metal Progress, ASM p. 84.

*Primary Examiner*—R. Dean

*Attorney, Agent, or Firm*—Browdy and Neimark

[57] ABSTRACT

An aluminum base alloy having a composition selected from:

(i)
Cr 1.5% to 7.0% by weight
Zr 0.5% to 2.5% by weight
Mn 0.25% to 4.0% by weight
Al remainder including normal impurities, and (ii) 7000 series Al alloys containing as added constituents:
Cr 0.5% to 3.0% by weight
Zr 0.5% to 2.5% by weight
Mn 0.1% to 2.0% by weight.

7 Claims, 1 Drawing Sheet

ALUMINUM ALLOYS

This application is a continuation of co-pending parent application Ser. No. 874,838, filed June 13, 1986, abandoned in favor of the present application, itself a continuation of the earlier application Ser. No. 528,706, filed Sept. 1, 1983, co-pending with and abandoned in favor of Ser. No. 874,838.

This invention relates to aluminium base alloys suitable for structural applications at high temperature.

Previously known aluminium alloys have not proved satisfactory for structural use, for example in the aerospace industry, at temperatures much above 100°-150° C. Higher temperature use has generally involved using titanium alloys which are very expensive.

Considerable work has been carried out with Al-8% Fe alloys to which ternary or quaternary additions have been made. Such alloys have to be made from powder (or other very rapidly solidified particulate starting material) and their consolidation can only be satisfactorily achieved at temperatures of the order of 450°-500° C. However at temperatures higher than about 300° C. they suffer a rapid loss of properties so they are of little practical use.

Proposals have also been made concerning an Al/Cr/Zr ternary alloy with both chromium and zirconium up to 4% by weight.

It is an object of the present invention to provide improved aluminium alloys which have good strength-/temperature properties; can be simply made by powder production and are easier to consolidate using normal production techniques than has hitherto been possible.

According to one aspect of the present invention there is provided an aluminium base alloy having a composition selected from:

Type (A)

Cr 1.5% to 7.0% by weight
Zr 0.5% to 2.5% by weight
Mn 0.25% to 4.0% by weight
Al remainder icluding normal impurities, and Type (B) 7000 series Al alloys containing as added constituents:
Cr 0.5% to 3.0% by weight
Zr 0.5% to 1.5% by weight
Mn 0.1% to 3.0% by weight Preferably the Type (A) alloy contains:
Cr 3.0% to 5.5% by weight
Zr 1.0% to 2.0% by weight
Mn 0.8% to 2.0% by weight and the Type (B) alloy is a 7075 Al alloy containing as added constituents:
Cr 0.8% to 1.5% by weight
Zr 0.8% to 1.2% by weight
Mn 0.4% to 0.8% by weight.

According to another aspect of the present invention there is provided a method of producing a semi-fabricated product from an aluminium base alloy selected from Al/Cr/Zr/Mn and Al/Zn/Mg/Cu/Cr/Zr/Mn comprising rapidly solidifying the molten alloy at a cooling rate of at least $10^{3°}$ C. $sec^{-1}$ and rapid enough to produce a relatively soft particulate (50-150 $kg/mm^2$) in which the bulk of the alloying additions are retained in solid solution consolidating the particulate and age hardening by heating the consolidated particulate to a temperature of 300°-500° C. The cooling rate may be between $10^{3°}$ and $10^{8°}$ C. $sec^{-1}$ and is preferably greater than $10^{4°}$ C. $sec^{-1}$.

It will be understood that the zirconium in the above alloys will usually include a significant proportion of hafnium which will act in the same way as zirconium. Thus where zirconium is mentioned herein it is to be understood as including a combination of zirconium and hafnium.

The above and other aspects of the present invention will now be described by way of example with reference to the single FIGURE of the accompanying drawing which is a graph showing percentage retention of tensile strength (PST) as a function of the logarithm of the holding time in minutes at elevated temperature for consolidated alloys A and B of Table 2 compared with Al/8 wt% Fe.

The development of high strength thermally stable precipitation hardened aluminium alloys by conventional ingot metallurgy is severely limited by a rapid loss in strength at temperatures in excess of 150° C., due to coarsening of the age hardening precipitates. Attempts have been made to develop aluminium alloys with high strength and thermal stability using rapid solidification techniques e.g. splat quenching, fine powder atomization spray casting and vapour deposition. These alloys generally contain between 8-10 wt% of transition elements (e.g. Fe, Mn, Ni, Mo) which are soluble in the melt but highly insoluble in the solid. The high cooling rates afforded by rapid solidification enables the retention of these elements in solid solution thereby conferring high strength and thermal stability on the consolidated product. The principal practical difficulties with this approach are the high solidification rates ($>10^{5°}$ C. $sec^{-1}$) required and the low consolidation temperatures (typically $<300°$ C.) required to achieve high property levels.

We have found that high levels of Cr (up to 7 wt%) could be retained in solid solution and confer thermal stability on the consolidated product. In addition, alloys containing high levels of chromium were significantly easier to consolidate into sheet and extrusion than "conventional" rapidly solidified alloys based on Al 8 wt% Fe. However, relatively high levels of a second transition element e.g. iron, were required to achieve satisfactory strength levels. It was also known that the addition of zirconium to rapidly solidified aluminium conferred an age-hardening response on the material.

Alloys of various compositions were rapidly solidified by a splat quenching technique (cooling rates $10^{3°}$-$10^{8°}$ C. $sec^{-1}$) and the variation in their hardness determined for ageing times up to 100 h using temperatures in the range 300° C.-500° C. The influence of the addition of 0.25-2.0 wt% Mn has been found to extend the thermal stability of the ternary alloy. The typical age-hardening response of selected alloys are given in Table 1 in comparison with published data on thermally stable non-age hardening rapidly solidified alloy based on Al[8] wt% Fe. In the context of Table 1 zone $\alpha$ is defined as material in which all solute additions are retained in solid solution (cooling rate $\sim 10^{6°}$ C. $sec^{-1}$) and zone $\beta$ is defined as material containing a fine dispersion of precipitated phase (cooling rate $\sim 10^{3°}$ C. $sec^{-1}$). The significant age-hardening response of the alloy system is evident. In addition the less rapidly solidified particulate (zone $\beta$) exhibits only slightly inferior properties compared to the more rapidly solidified material (zone $\alpha$), this feature being particularly evident in the quaternary Mn-containing alloys. Comparison with the Al 8 wt% Fe system clearly shows the enhanced thermal stability of the alloy system of the present invention and the marked improvement in zone $\beta$ properties enabling cooling rates as low as $10^{3°}$ C. $sec^{-1}$ to be used in manufacture of the rapidly solidified particulate.

The work above enabled the definition of two alloy compositions:

| | | |
|---|---|---|
| ALLOY A | HIGH STRENGTH THERMALLY STABLE ALLOY | |
| | Cr | 5.25 |
| | Zr | 1.75 |
| | Mn | 1.75 |
| ALLOY B | MEDIUM STRENGTH THERMALLY STABLE ALLOY | |
| | Cr | 3.7 |
| | Zr | 1.2 |
| | Mn | 1.0 |

Bulk quantities of the alloys were produced using two different techniques:

(a) Splat quenching

In which a thin stream of molten alloy of the required composition is argon atomised to fine droplets. These droplets impinge on a rotating cooled substrate to form thin flakes of material. The cooling rate of the particulate can vary between $10^{3°}$ C. $sec^{-1}$ and $10^{8°}$ C. $sec^{-1}$ but is generally $10^{4°}$ C. $sec^{-1}$ to $10^{6°}$ C. $sec^{-1}$. The individual flakes contain both zone $\alpha$ and zone $\beta$ in the relative proportions 50–70% zone $\alpha$, 30–50% zone $\alpha$, depending on percent solute content.

(b) Conventional powder atomisation

In which a stream of molten metal of the required composition is air atomised to fine particulate. A range of powder sizes is produced which can be fractionated e.g. a fraction containing 75 $\mu$m and less particulate with a typical cooling rate of $2\times10^{4°}$ C. $sec^{-1}$ (predominately zone $\alpha$) and a fraction containing particles in the size range 125–420 $\mu$m with a typical cooling rate of $10^{3°}$ C. $sec^{-1}$ (predominately zone $\beta$). This material was produced using standard powder production facilities with no modifications.

The bulk material of the two alloys was then consolidated into sheet and extrusion using conventional techniques and a working temperature of 350° C. Table 2 details the resultant tensile properties of the material in the peak hardness condition and the drawing shows the retention of tensile strength after exposure to elevated temperatures. All the results shown are independent of composition, cooling rate and fabrication route.

The tensile property data indicates that as expected higher tensile strength is obtained from material containing the higher percentage zone $\alpha$. This corresponds to a cooling rate of $2\times10^{4°}$ C. $sec^{-1}$ or greater which is an order of magnitude lower than that necessary to produce similar strength in an Al 8% Fe based alloy. Furthermore the results show that material containing predominately zone $\beta$ (cooling rate $10^{7°}$ C. $sec^{-1}$) has attractive tensile properties, a feature not observed in other alloy systems containing high additions of transition elements. The tensile properties of alloy A compare favourably with those obtained on other alloy systems (e.g. Al 8 wt% Fe) which require fabrication at temperatures <300° C. The drawing illustrates that the thermal stability of consolidated particulate (which is independent of cooling rate) is a significant improvement over Al 8% Fe base alloys. A further feature of the Al-Cr-Zr-Mn system is that by careful control of the fabrication conditions, it is possible to age-harden the material during processing obviating the need for subsequent heat treatment.

We have also found that the 7000 series alloys with the addition of Cr, Zr and Mn may form the basis of high strength, thermally stable alloys. In particular a 7075-type alloy containing 1.2 wt% Cr, 1.0 wt% Zr, 0.5 wt% Mn was produced via splat quenching and powder atomisation. The tensile properties of consolidated material (sheet and extrusion) using standard 7075 processing practices was 25% higher than conventionally processed 7075 alloy sheet or extrusion and the thermal stability was increased by ~100% in the temperature range 150° C.—400° C. for exposure times up to 100 h.

Thus the present invention provides alloys in which rapid solidification techniques may be used to produce a relatively soft, i.e. ductile, particulate which permits easy consolidation at the conventional hot working temperature (350° C.–500° C.) of aluminium and its alloys but which develops high strength and thermal stability on age hardening at elevated temperature (300°–500° C.) Furthermore lower solidification rates (as low as $10^{3°}$ C. $sec^{-1}$) can be used in the production of a suitable pre-consolidated particulate.

It will be understood that the particulate may be consolidated by applying it directly to a rolling mill to produce sheet in a continuous process. The particulate may also be consolidated and then extruded. The semi-fabricated product of the rolling or extrusion process will have room temperature strengths equal to or greater than the 7075 alloy in the T76 temper. For example, the Al/Zr/Cu/Mn alloy referred to above will have 7075 T76 properties and will be usable up to 350° C. The Al/Zn/Mg/Cu/Cr/Zr/Mn alloy referred to above will have strengths 20% greater than 7075 T6.

The 7000 series of alloys refers to the international alloy designations recorded by the Aluminium Association.

It will also be understood that many additional constituents may be added to the base alloys without deleteriously affecting the properties of the semi-fabricated and fabricated products. Such additional constituents may, for example, include transition elements such as iron in quantities greater than normally found as impurities in aluminium. This is because the rapid solidification technique required by the present invention suppresses the formation of coarse intermetallics.

TABLE 1

The age-hardening response of alloys in the Al—Cr—Zr(Mn) system

| Alloy composition wt % | | | Alloy Micro-structure | Micro hardness (25 g load) Kg/mm² | | Time to max hardness in hours | |
|---|---|---|---|---|---|---|---|
| Cr | Zr | Mn | | as produced | aged to max. hardness | 350° C. | 400° C. |
| 4.8 | 2.0 | | Zone $\alpha$ | 118 | 198 | 37 | 2 |
| | | | Zone $\beta$ | 108 | 137 | 8 | 4 |
| 5.5 | 1.7 | 1.0 | Zone $\alpha$ | 140 | 200 | >65 | 4.5 |
| | | | Zone $\beta$ | 126 | 177 | >65 | 4 |
| 3.1 | 0.9 | 0.9 | Zone $\alpha$ | 80 | 160 | >24 | 24 |
| | | | Zone $\beta$ | 75 | 135 | >24 | 24 |
| Al 8 | wt % | | Zone $\alpha$ | ~250 | — | Rapid loss in | |
| | Fe | | Zone $\beta$ | ~120 | — | properties at | |
| | | | | | | temperatures in | |

TABLE 1-continued

The age-hardening response of alloys in the Al—Cr—Zr(Mn) system

| Alloy composition wt % | | | Alloy Micro-structure | Micro hardness (25 g load) Kg/mm² as produced | aged to max. hard-ness | Time to max hardness in hours | |
|---|---|---|---|---|---|---|---|
| Cr | Zr | Mn | | | | 350° C. | 400° C. |
| | | | | | | excess of 300° C. | |

Hardness was determined by a Vickers diamond pyramid in accordance with standard procedures.

TABLE 2

Room temperature tensile properties of consolidated alloys A and B at peak hardness, compared to Al 8% Fe

| Alloy Compo-sition | Production Route | Tensile properties 0.2 Ps MPa | TS Mpa | El % |
|---|---|---|---|---|
| A | Splat quenched, rolled to sheet @ 350° C. ~50% zone α ~50% zone β | 508 | 565 | 3 |
| A | Air atomised, rolled to sheet @ 350° C. −75 μm size powder ~60% zone α, 40% zone β | 530 | 588 | 6 |
| A | Air atomised, rolled to sheet @ 350° C. 125–420 μm powder ~5% zone α, ~95% zone β | 430 | 525 | 8 |
| B | Splat quenched; rolled to sheet @ 350° C. ~60% zone α 40% zone β | 448 | 486 | 5 |
| B | Air atomised rolled to sheet @ 350° C. −75 μm size powder ~70% zone α, 30% zone β | 460 | 502 | 8 |
| B | Air atomised, rolled to sheet @ 350° C. 125–420 μm powder 10% zone α, 90% zone β | 366 | 426 | 9.5 |
| Al 8 wt % Fe | Splat quenched, ground to −150 mesh powder and extruded @ 300° C. 60% zone α | 503 | 570 | 5 |
| Al 8 wt % Fe | Gas atomised, extruded predominately zone β | — | 360 | — |

In the above Table 2 the abbreviations used have the following meanings:-
0.2 Ps—0.2% Proof Stress
TS—Tensile Strength
El—Elongation
MPa—Mega Pascals

I claim:

1. An aluminum base alloy having a composition consisting essentially of:

(A)
Cr 1.5% to 7.0% by weight
Zr 0.5% to 2.5% by weight
Mn 0.25% to 4.0% by weight
Al remainder including normal impurities, or (B) 7000 series Al alloys containing as added constituents:
Cr 0.5% to 3.0% by weight
Zr 0.5% to 2.5% by weight
Mn 0.1% to 2.0% by weight, said alloy having been quenched from a molten state at a cooling rate between about $10^{3°}$ and $10^{8°}$ C./sec to achieve aductile particulate having a hardness of 50–150 kg/mm² and thereafter having had its hardness increased by heating at about 300°–500° C.

2. An alloy according to claim 1 in which (A) contains:
Cr 3.0% to 5.5% by weight
Zr 1.0% to 2.0% by weight
Mn 0.8% to 2.0% by weight and range (B) is Al alloy 7075 containing as added constituents:
Cr 0.8% to 1.5% by weight
Zr 0.8% to 1.2% by weight
Mn 0.4% to 0.8% by weight.

3. A method of producing a semi-fabricated product selected from the group consisting of an aluminum base alloy consisting essentially of:

(A)
Cr 1.5% to 7.0% by weight
Zr 0.5% to 2.5% by weight
Mn 0.25% to 4.0% by weight
Al remainder including normal impurities, or (B) 7000 series Al alloys containing as added constituents:
Cr 0.5% to 3.0% by weight
Zr 0.5% to 2.5% by weight
Mn 0.1% to 2.0% by weight, comprising the steps of rapidly solidifying the molten alloy at a cooling rate of at least $10^{3°}$ C. $sec^{-1}$ and sufficiently rapidly to produce a ductile particulate (50–150 kg/mm²) which is non-brittle and in which the bulk of the alloying additions are retained in solid solution, consolidating the particulate and age hardening by heating the consolidated particulate to a temperature of 300° C. − 500° C. to increase said alloy in hardness from its as-quenched ductile state.

4. A method according to claim 3 in which the cooling rate is greater than $2\times10^{4°}$ C. $sec^{-1}$.

5. A method according to claim 3 in which the consolidation of the particulate is carried out under conditions to yield a fully age hardened product.

6. A ductile aluminum base alloy according to claim 1 in particulate form.

7. The alloy of claim 1, wherein said alloy increases in hardness from its as-quenched hardness when heated in the as-quenched state at about 350°–500° C.

* * * * *